US008235038B2

(12) United States Patent
Adams

(10) Patent No.: US 8,235,038 B2
(45) **Date of Patent: *Aug. 7, 2012**

(54) SCUBA MASK PURGING APPARATUS AND METHOD

(75) Inventor: Phillip M. Adams, Henderson, NV (US)

(73) Assignee: Phillip M. Adams, Henderson, NV (US)

( * ) Notice: Subject to any disclaimer, the term of this patent is extended or adjusted under 35 U.S.C. 154(b) by 275 days.

This patent is subject to a terminal disclaimer.

(21) Appl. No.: 12/622,330

(22) Filed: Nov. 19, 2009

(65) Prior Publication Data

US 2010/0126503 A1 May 27, 2010

Related U.S. Application Data

(63) Continuation of application No. 10/929,851, filed on Aug. 30, 2004, now Pat. No. 7,621,267.

(51) Int. Cl.

| | |
|---|---|
| ***B63C 11/02*** | (2006.01) |
| ***B63C 11/00*** | (2006.01) |
| ***A62B 7/04*** | (2006.01) |
| ***A62B 9/00*** | (2006.01) |

(52) U.S. Cl. ..... 128/201.27; 128/201.26; 128/204.26; 128/205.22; 405/185; 405/186

(58) Field of Classification Search ..... 128/200.29, 128/201.22, 201.24–201.29, 200.25, 202.13, 128/202.15, 206.22; 405/186, 192, 193; 2/428, 426, 430, 446

See application file for complete search history.

(56) References Cited

U.S. PATENT DOCUMENTS

| | | | | |
|---|---|---|---|---|
| 4,114,389 | A * | 9/1978 | Bohmrich et al. | 405/186 |
| 4,176,418 | A * | 12/1979 | Scott | 441/96 |
| 4,498,471 | A * | 2/1985 | Kranz et al. | 128/204.26 |
| 5,106,236 | A * | 4/1992 | Hancock et al. | 405/186 |
| 6,227,199 | B1 * | 5/2001 | Garofalo | 128/204.26 |
| 6,666,622 | B1 * | 12/2003 | Courtney et al. | 405/186 |
| 7,621,267 | B1 * | 11/2009 | Adams | 128/201.27 |

* cited by examiner

*Primary Examiner* — Annette Dixon

(57) ABSTRACT

A scuba mask purging apparatus and method providing selective introduction of pressurized air into a scuba mask to initiate purging, pressure balancing, and de-fogging. An inlet valve, typically positioned conveniently on the top or the side of the mask may control the release of pressurized air into the mask. A pressure-sensitive outlet valve releases the pressurized air to force water from the mask. The outlet valve may be positioned on the lower portion of the mask or at a location where water is likely to collect.

20 Claims, 10 Drawing Sheets

SCUBA MASK PURGING APPARATUS AND METHOD

RELATED APPLICATION

This application is a continuation of U.S. patent application Ser. No. 10/929,851 filed Aug. 30, 2004 now U.S. Pat. No. 7,621,267.

BACKGROUND

1. The Field of the Invention

This invention relates to scuba masks and apparatus and methods for purging water from scuba masks as well as equalizing pressure within a scuba mask.

2. The Background Art

A self-contained underwater breathing apparatus (SCUBA) typically includes a mask covering the eyes, nose, and surrounding areas of a user's face; a scuba tank containing pressurized air; and a series of regulators to provide breathing air to a user. During a dive several problems, among others, may arise from the mask. First, water may seep into the mask making vision through the mask difficult and discomfiting a user by the presence of water by the eyes, nose, or both. Second, the air trapped between the mask and the face of a user is initially at the pressure of the surface air. Accordingly, as a diver descends into the water, the pressure differential between the trapped air and the surrounding water increases, pressing the mask against the face potentially causing discomfort to a user. Third, humidity in the mask combined with the warm face temperature and cold lens temperature of the mask will fog the mask with condensation.

Pressure may be equalized and water purged by the user exhaling through the nose, thus introducing pressurized air into the confined space of the mask. A user may remove, rinse, and replace the mask to rid the lens of fog. To remove, or purge, any water from the mask, a user must typically both exhale through the nose and lift the lower edge of the mask away from the user's face to allow the air to force the water down and out.

However, this method of equalizing and purging is problematic. For example, a user may be congested. Furthermore, in eventful dives or where the diver is a beginner, remembering to equalize and purge may be problematic. To remove a foggy mask may be as frightening as to move blindly forward trying to follow a leader. It may also cause distress and discomfort to inexperienced divers to forcefully blow pressurized air from their noses at great depths. Purging water from the mask by lifting the mask away from the face is also a frightening experience for beginners and may also permit a large inrush of water if done improperly. Drowning may be possible, but fear thereof is highly probable in such circumstances.

Accordingly, what is needed is a system to permit equalizing of pressure within a mask, purging water from a mask, drying mask air, and the like in a manner that feels safe and convenient to users. Such a system should allow for equalizing and purging that will not add to the stress and complexity of using SCUBA at great depths.

It would be an advancement in the art to use the dried and regulated air from a pressure source to equalize pressure, purge water, or dry the air within the mask. It would be a further advancement in the art to use regulated air to force unwanted water from the mask through a pressure-sensitive or otherwise automated or one-way outlet valve.

BRIEF SUMMARY OF THE INVENTION

A typical scuba system includes a mask having a lens, through which a user sees, and a skirt surrounding the lens and creating a seal against the face of a wearer. A strap, or like structure may maintain the lens and skirt in engagement with the face of a user. A tank of pressurized air is delivered through first stage and second stage regulators to the mouth of a user for breathing.

Pressurized air from the scuba tank may be delivered to the mask to increase the pressure in the space defined by the mask and the face of a user. Introducing pressurized air forces air out of the mask and thereby also forces out water that may have collected in the mask. This necessarily equalizes the pressure within the confined space with that of the surrounding water. Since the compressed air in the tank is dry it does not introduce humidity as would exhaled air. Moreover, tank air will be so dry it will provide evaporation of moisture in the mask cavity.

An inlet valve may be positioned in an accessible position on the scuba mask, allowing a user to open the inlet valve and allow pressurized air to enter. An outlet valve may be positioned on the mask to readily discharge accumulated water, such as at a lowest point where water is likely to collect. The outlet valve may be pressure sensitive, such that introduction of pressurized air causes the outlet valve to open permitting unwanted water to be forced out. For example, a poppet type valve may seal under the force of a spring and ambient water, but open in response to air pressure inside the mask.

The pressurized air from the tank may pass through the first stage regulator and the second stage regulator used for breathing before entering the mask. Alternatively, a separate second stage regulator may be dedicated to controlling the flow of air into the mask. In yet another alternative, fluid friction with the walls of supply tubes or constricting apertures may control the volume of air flow. In certain embodiments, a comparatively small but constant flow of air into the mask may provide substantially constant purging and drying within the mask.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of systems in accordance with the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, may be arranged and designed in a wide variety of different configurations. Thus, the following more detailed description of the embodiments of systems and methods in accordance with the present invention, as represented in FIGS. 1 through 12, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

Figure 1:
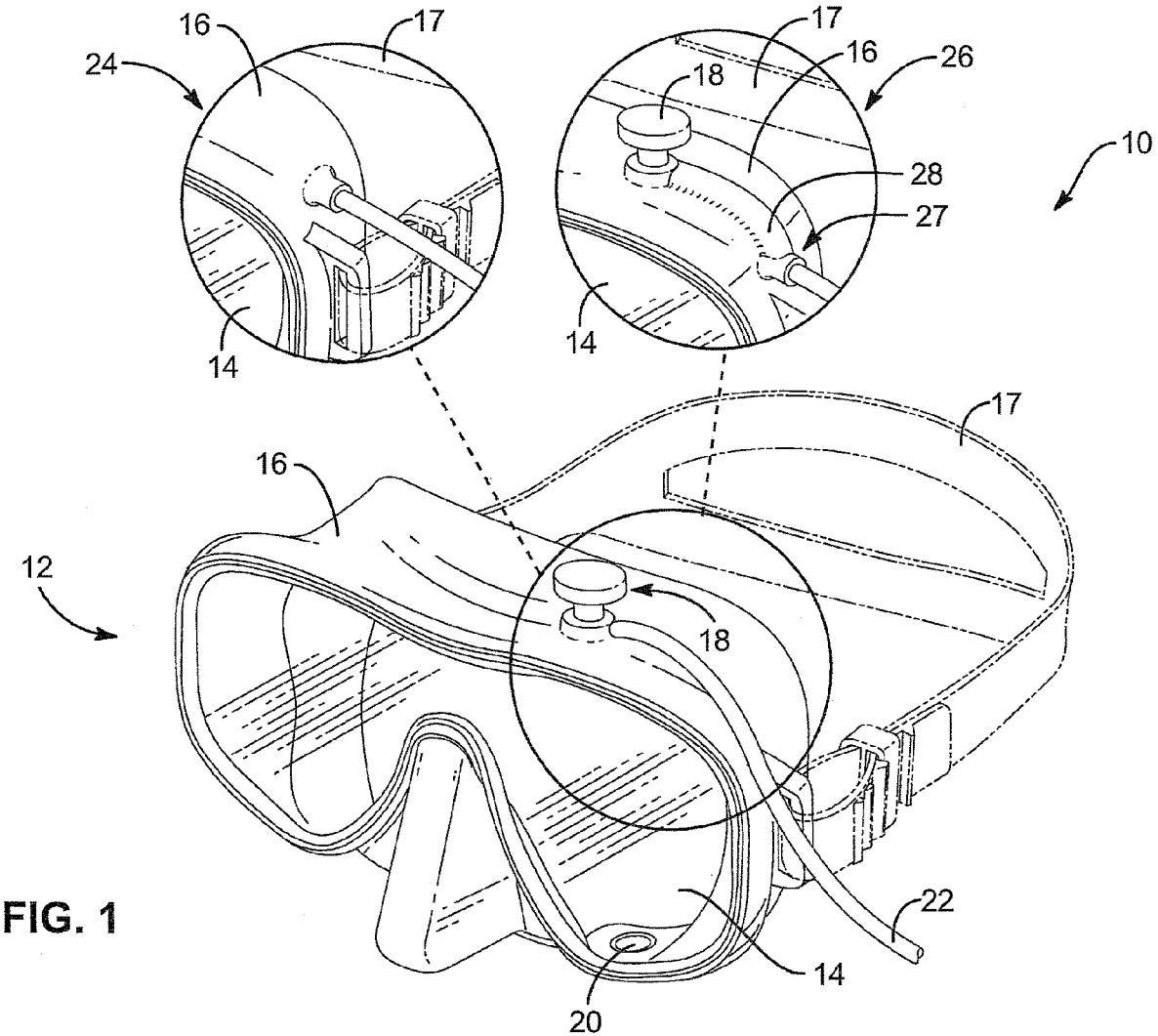
FIG. 1 is perspective view of a scuba mask having a purging system, in accordance with the invention.

Referring to FIG. 1, a system 10 in accordance with the present invention may include a scuba mask 12. The scuba mask 12 may have various embodiments as known in the art. A typical scuba mask 12 may include a lens 14 made of tempered glass or other material that is both transparent and capable of withstanding the range of pressures existent deep under water. A lens 14 may be divided or extend as a single unit. A scuba mask 12 may include a skirt 16 surrounding the lens. The skirt 16 may include a flexible edge shaped to conform to the face of a user. A strap 17 may urge the skirt 16 into sealed contact with the face of a user.

The system 10 may include an inlet valve 18 positioned to allow pressurized air from a scuba tank, or other source of pressurized air, to pass through the wall of the skirt 16. In some embodiments, the inlet valve 18 may be positioned to allow air passage through the lens 14. In other embodiments, the inlet valve 18 may be positioned toward the top of the mask 12. For example, the inlet valve 18 may be positioned on the portion of the skirt 16 near the forehead of a user when the mask 12 is worn. Placement may be selected to provide ease of access while keeping air conduits from obstructing vision or motion.

The system 10 may include an outlet valve 20 positioned to allow air, water, or some combination thereof to pass through the lens 14 or skirt 16. The outlet valve 20 may typically be positioned near the lower portion of the lens 14 or skirt 16 such that pressurization of the air in the space enclosed by the mask 12 and the face of a user will be more likely to cause water in the enclosed space to be forced out of the outlet valve 20. For example, in the illustrated embodiment, the outlet valve 20 is located in the skirt 16 in the lower portion of the skirt 16 near the cheek of a user when the mask 12 is worn.

In selected, embodiments, a supply tube 22 may securely convey air from a scuba tank, or other source, to a mask 12. In certain embodiments, a supply tube 22 may extend from an air source to an inlet valve 18 positioned on the mask 12. Alternatively, the supply tube 22 may secure directly 24 to the skirt 16 and the inlet valve 18 may be positioned elsewhere. That is, the inlet valve 18 may control the flow of air from the supply tube 22 to the mask 12 from a location spaced from the mask 12. For example, the inlet valve 18 may be positioned on the supply tube 22 at a location between a mask 12 and a scuba tank.

In some embodiments a supply tube 22 may be formed as an integral part 26 of a skirt 16. In this approach, the point of attachment 27 of the supply tube 22 to the mask 12 and the inlet valve 18 may be separated. An integral portion 28 of the supply tube 22 may extend from the point of attachment 27 to the inlet valve 18.

Figure 2:
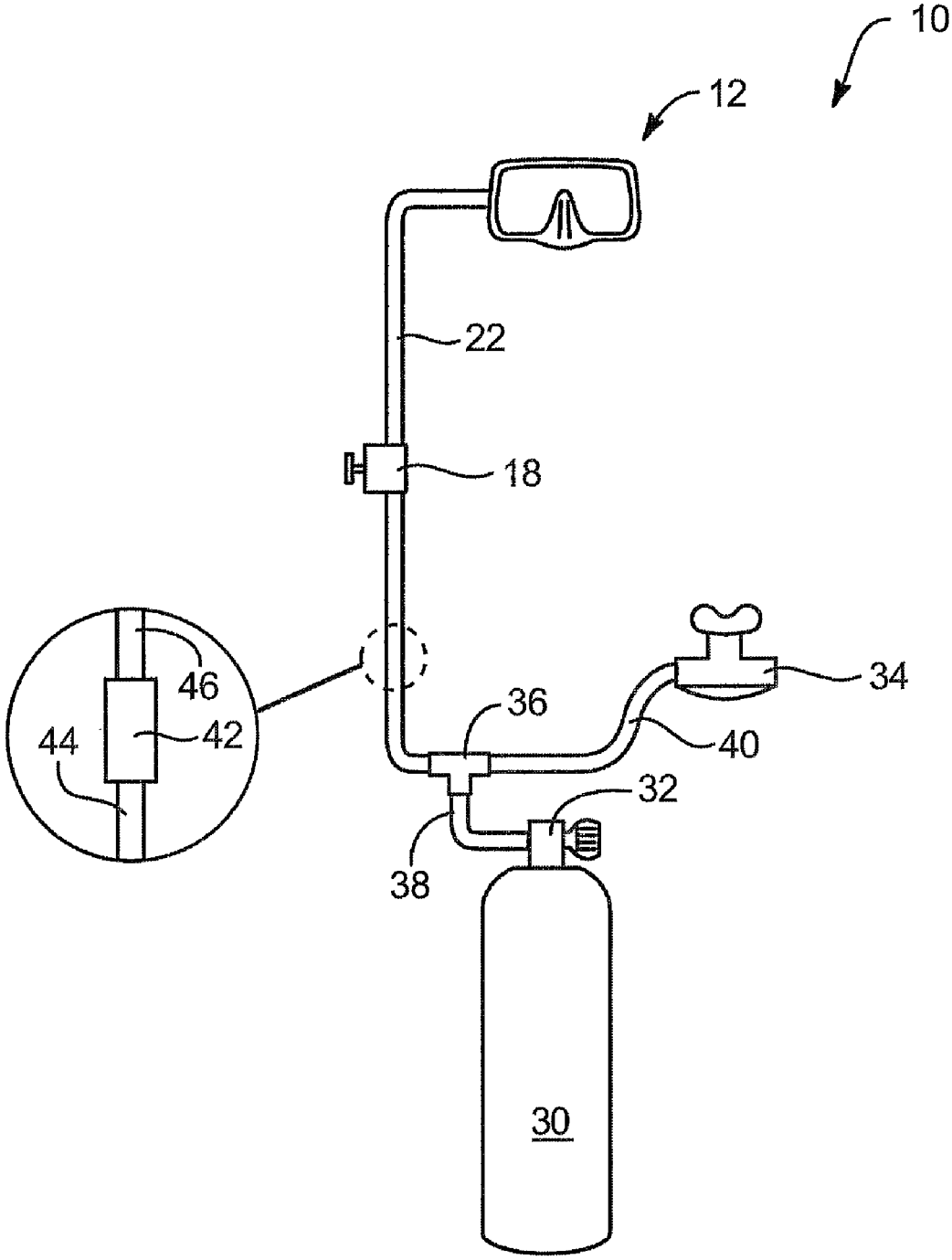
FIG. 2 is a schematic representation of a purging system and scuba tank, in accordance with the invention.

Referring to FIG. 2, in certain embodiments, a scuba tank 30 may have a first stage regulator 32 causing a reduction of the pressure of gas released from the tank 30. In one embodiment, separate tubes may supply pressurized air to a system 10 in accordance with the present invention and to a second stage regulator 34 providing breathing air to a user. Accordingly a tee 36, manifold, or the like may secure to the first stage regulator 32, either directly or through a short connecting tube 38. A breathing supply tube 40 may connect to the tee 36 or manifold and the second stage regulator 34.

In some embodiments, an additional second stage regulator 42 may be interposed between the tank 30 and the inlet valve 18. Alternatively, in some embodiments, a first stage regulator 32 may sufficiently reduce the pressure of the air to a safe level and the additional second stage regulator 42 may be omitted. The inside diameters of any tubes 22 conducting air from the tank 30 to the mask 12 may be chosen such that excessive volumes of air are not released, notwithstanding the lack of a second stage regulator 42.

Alternatively, the size of an aperture through which air must pass during its passage from the tank 30 to the mask 12 may be chosen to limit the volume of air flow. For example, air flowing from the inlet valve 18 into the mask may pass through a constricting aperture. An orifice plate may limit flow and pressure. Of course, the aperture or orifice may be positioned elsewhere in the air passage between the tank 30 and the mask 12. In some embodiments, both an aperture and an appropriately sized tube 22 may be used to regulate air flow.

A tube 44 may extend from the tee 36 to the regulator 42 and a tube 46 may extend from the regulator 42 to the inlet valve 18. The supply tube 22 may extend from the inlet valve to the mask 12. Alternatively, in embodiments having an inlet valve 18 secured to the mask 12, the supply tube 22 may secure directly to the regulator 42.

Figure 3:
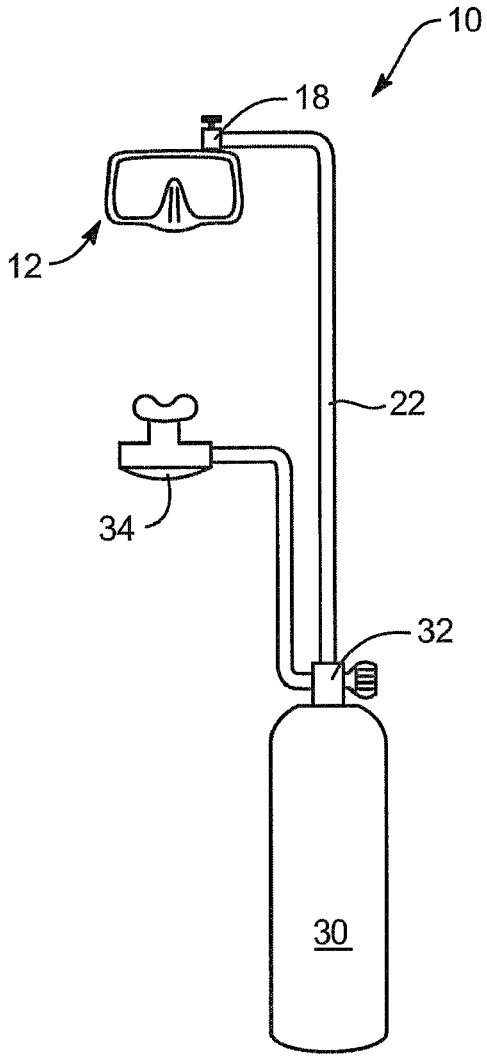
FIG. 3 is a schematic representation of an alternative embodiment of a purging system and scuba tank, in accordance with the invention.

Referring to FIG. 3, many first stage regulators 32 provide one or two high pressure ports for pressure gauges and three or four low pressure ports for second stage regulators 34, inflation hoses leading to the buoyance compensation device, or dry suit hoses. In selected embodiments, a supply tube 22 may connect to a low pressure port of a first stage regulator 32 to provide air for the mask 12.

Figure 4:
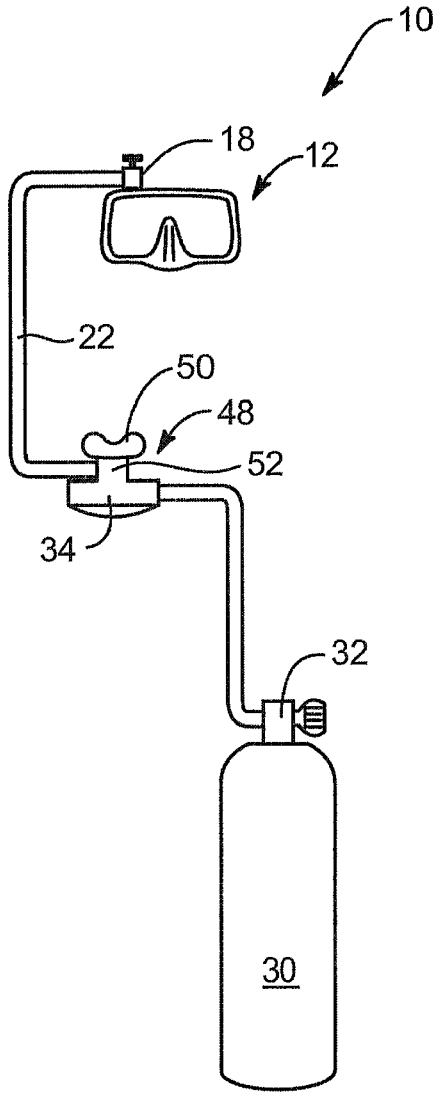
FIG. 4 is a schematic representation of another alternative embodiment of a purging system and scuba tank, in accordance with the invention.
Figure 5:
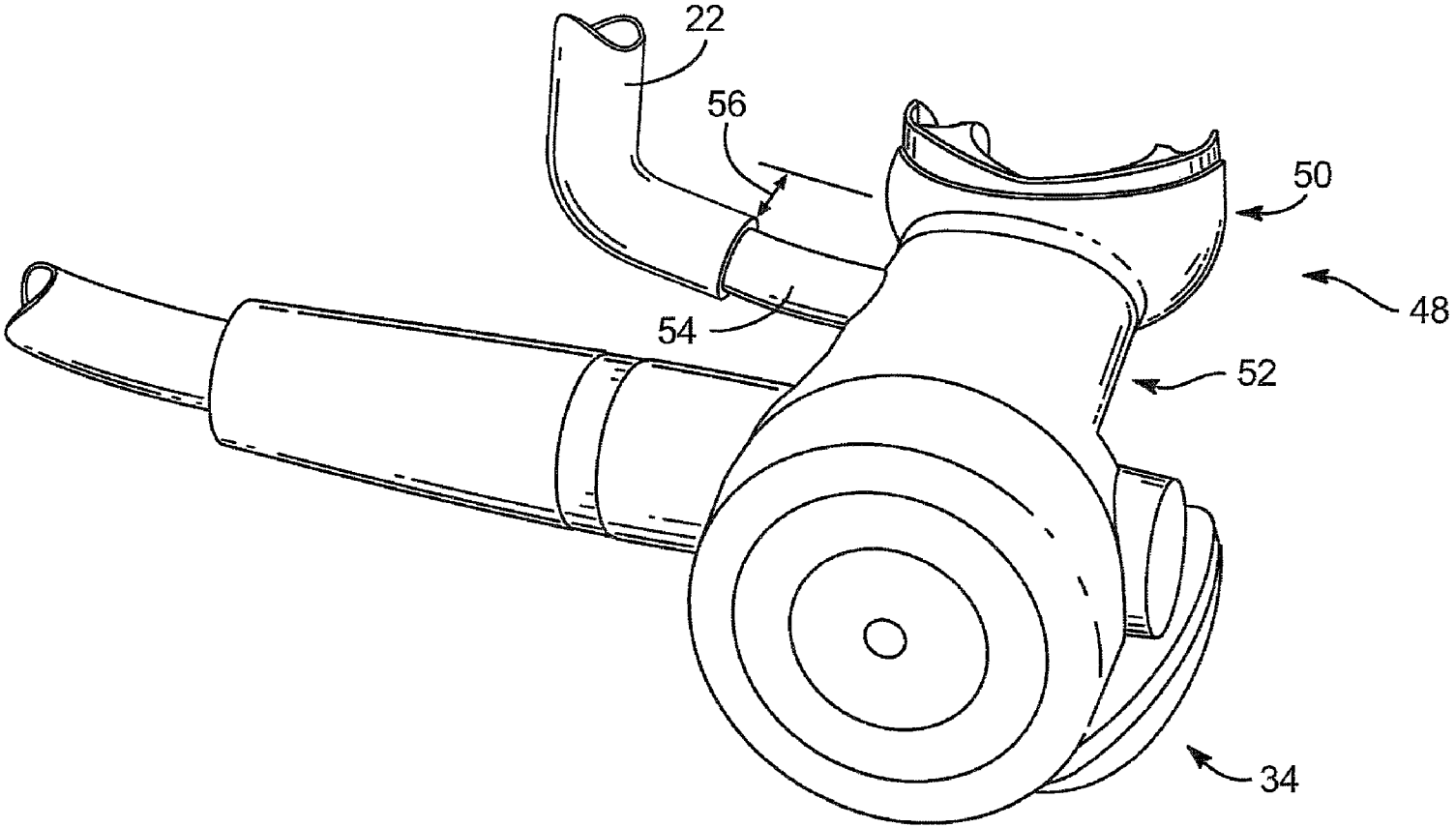
FIG. 5 is a perspective view of a supply tube secured to the mouthpiece of a second stage regulator, in accordance with the invention.

Referring to FIGS. 4 and 5, in some embodiments, a supply tube 22 may communicate air from a second stage regulator 34 or from a mouthpiece 48 extending from a second stage regulator 34. For example, a mouthpiece 48 may include a grip portion 50, which is directly inserted into the mouth of a user. A spacing portion 52 may extend between the second stage regulator 34 and the grip portion 50. The supply tube 22 may be in fluid communication with an air passage within the spacing portion 52 of the mouthpiece 50 such that the regulated air from the second stage regulator 34 may flow to reach the inlet valve 18.

A supply tube 22 may connect to the spacing portion 52 in a manner such as not to interfere with the mouth of a user surrounding the grip portion 50. For example, an outlet tube 54 may protrude from the spacing portion 52 spaced a distance 56 from the grip portion 50. The supply tube 22 may then secure to the outlet tube 54 by means of hose clamps, glue, molding, other monolithic formation, or any other suitable means for splicing tubes.

Figure 6:
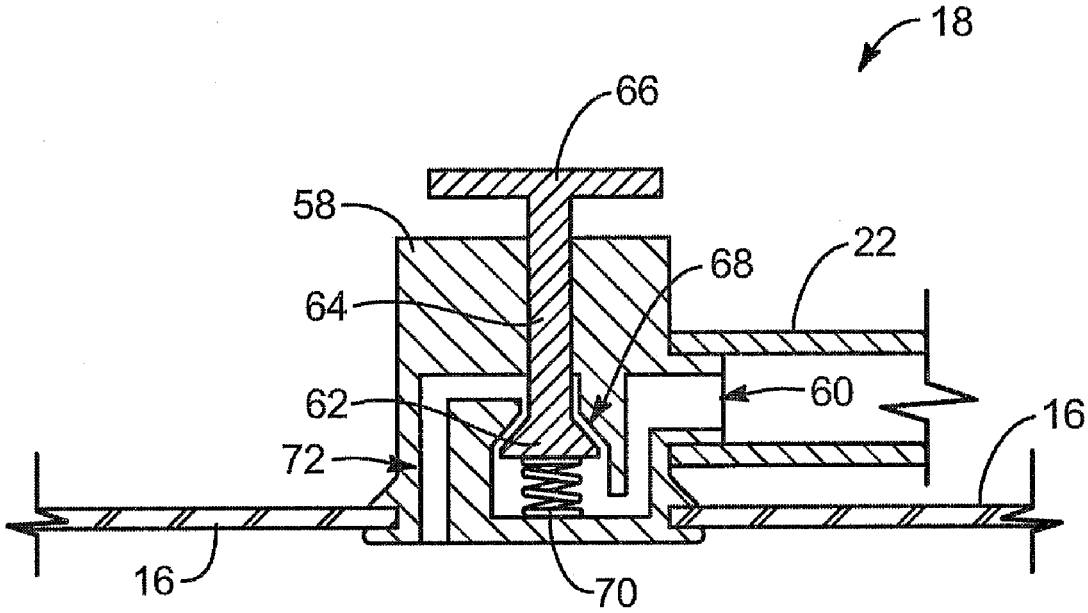
FIG. 6 is a schematic representation of one embodiment of an inlet valve, in accordance with the invention.

Referring to FIG. 6, an inlet valve 18 may have various embodiments allowing selective opening and closing thereof. In some embodiments, a purging system 10 may also serve to equalize pressure within the mask 12 and the water outside the mask 12. Accordingly, the inlet valve 18 may be pressure sensitive, or otherwise controlled by a sensor, opening when a sufficient, pre-determined, pressure difference exists between the air inside the mask 12 and the water outside the mask 12. Alternatively, a second stage regulator 34, 42 may serve the function of the inlet valve 18 and automatically release air into the mask 12 when the pressure within the mask 12 is lower than the surrounding water by some selected amount.

In the illustrated embodiment, the inlet valve 18 includes a valve body 58. The valve body 58 may have an inlet passage 60 formed therein conducting air from the supply tube 22 to the valve seal 62. The valve seal 62 may secure to a valve stem 64 extending up through the valve 18 and securing to a button 66 or similar structure. The valve seal 62 may be pressed against a valve seat 68 by a spring 70, or like mechanism. Pressing the button 66 may cause the seal 62 to move downward, compressing the spring 68 and permitting air to pass between the valve seal 62 and the valve seat 66 into the outlet passage 72. The outlet passage 72 may conduct the air into the space confined by the mask 12 and the face of a user, thereby driving water out of the mask 12 through the outlet valve 20.

Figure 7:
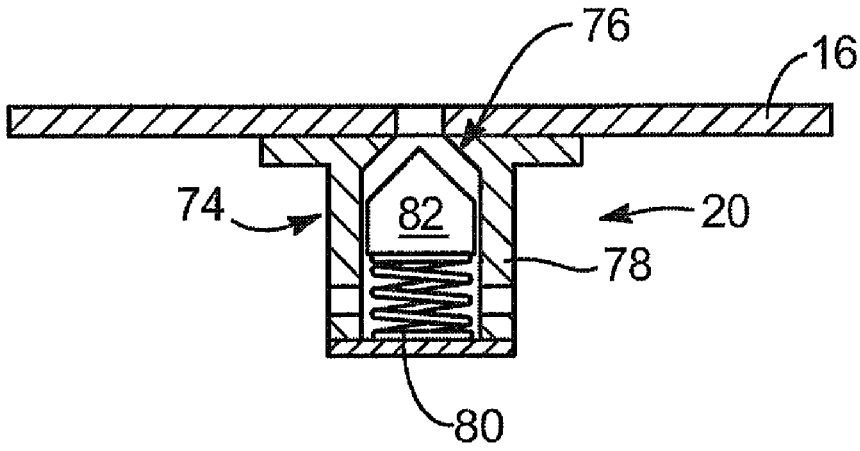
FIG. 7 is a schematic representation of one embodiment of an outlet valve, in accordance with the invention.

Referring to FIG. 7, in some embodiments an outlet valve 20 may be pressure actuated. That is, an increase of pressure in the space confined by the mask 12 and the face of a user may cause the outlet valve 20 to open. Accordingly the outlet valve 20 may be embodied as a poppet valve 74, or valve having similar operation. An outlet valve 20 formed as a poppet valve 74 may include a valve seat 76 formed in a valve body 78 secured to the lens 14 or skirt 16 of the mask 12. A spring 80 or other biasing mechanism may press a valve seal 82 against the valve seat 76 to create a seal.

Figure 8:
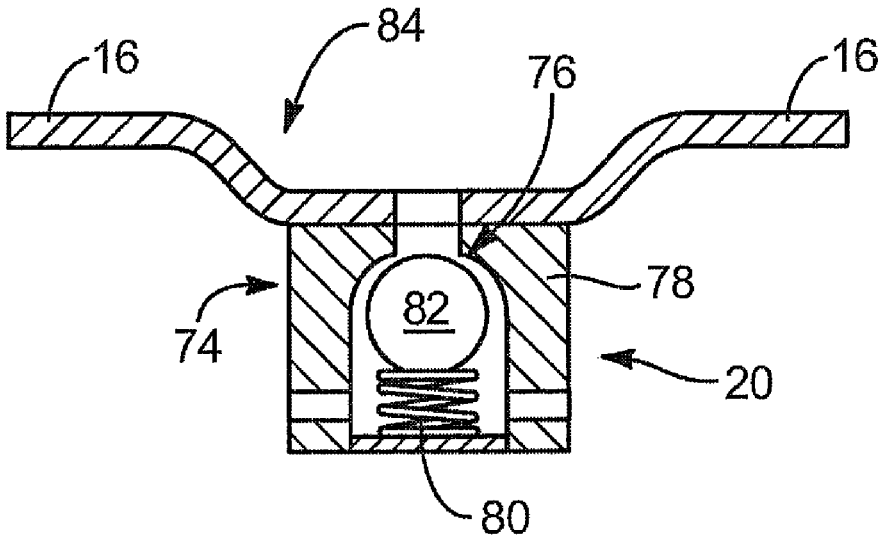
FIG. 8 is a schematic representation of an alternative embodiment of an outlet valve, in accordance with the invention.

In an alternative embodiment, an outlet valve 20 may be formed as a gland valve, opening at internal pressure greater then that of the ambient and sealing closed like a flat tube with an opposite pressure differential. In general, selected output valves 20 may operate under the principle that when sufficient pressure is exerted on the valve 20 to overcome the force of the ambient, bias, spring 80, some combination thereof, or the like, the valve seal may be moved away from the sealed position (e.g. valve seat 76), allowing air and water to flow through the valve 20. Referring to FIG. 8, an outlet valve 20 may have various embodiments and secure to the mask 12 in a variety of configurations. For example, the valve seal 82 may be shaped as a plate, cone, or sphere made of steel, plastic, or like material. A valve seat 76 may be formed as an "O" ring, circle, hemisphere, or the like to engage a flat, conical, or spherical valve seal 82. In some embodiments, the skirt 16 of a mask 12 may have a depression 84 formed therein adjacent the valve 20 to collect water that may have entered a mask 12 and to facilitate purging.

Figure 9:
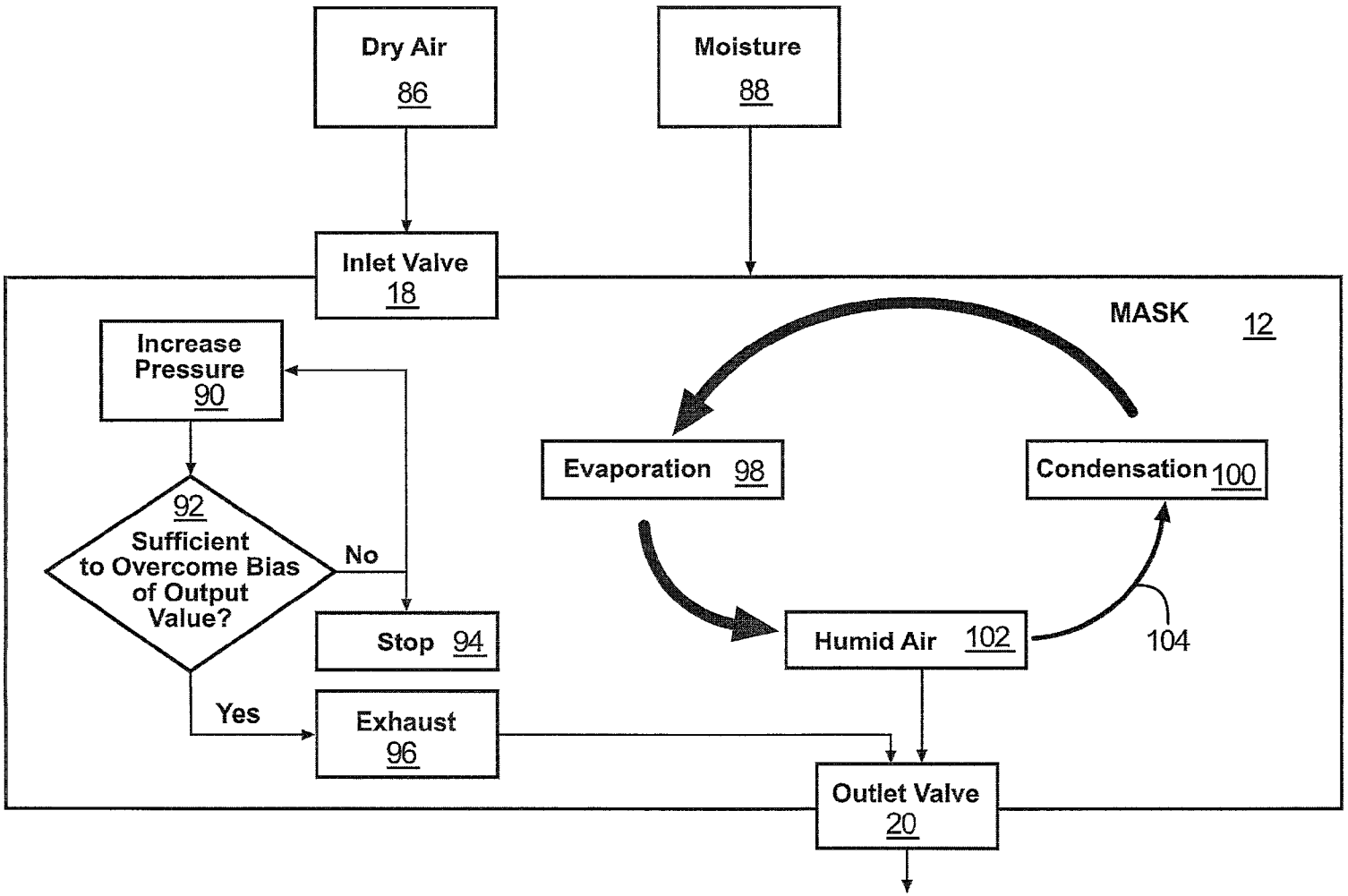
FIG. 9 is a block diagram illustrating various processes in accordance with the invention for removing unwanted moisture from within the cavity formed by the face of a user and the interior of a mask.

Referring to FIG. 9, in view of the foregoing, there are many different ways in which a source of air may be connected to a mask 12. Similarly, there are many valving arrangements that facilitate and control the flow of air into a mask 12 and the flow of air and water out of a mask 12. All suitable supply and valving arrangements may be considered within the scope of the present invention.

Accordingly, dry air 86 (i.e. air containing a limited amount of water vapor, typically, substantially none) may be introduced into a mask 12 in any suitable manner. Air 86 may be absolutely dry, with no vapor or may have so little as to have a very low relative humidity and still serve a drying purpose. For example, in selected embodiments, dry air 86 may be introduced into a mask 12 through an inlet valve 18. Moisture 88 may also be introduced into a mask 12 either as ambient water or simply as sweat. Moisture 88 may be present in two phases, liquid and vapor. Liquid may enter a mask 12 through installation capture, adhesion of droplets upon rinsing, a leak, or an imperfect seal between the skirt 16 and the face of a user. The presence of liquid within a mask 12 may also be the result of condensation of vapor. Vapor within a mask 12 may be caused by perspiration of the user or evaporation of liquid that has found its way inside the mask 12.

Different processes may be used to rid a mask 12 of unwanted moisture 88. A change in pressure may be used to rid a mask 12 of liquid while a slow bleed of air may be used to lower the amount of vapor within a mask 12. For example, an injection of air 86 (either dry or of low humidity) into the mask 12 may increase 90 the pressure therein. This increase 90 may be sufficient 92 or insufficient 92 to overcome the bias of the output valve 20.

If the increase 90 is insufficient 92 to overcome the bias of the output valve 20, the increase in pressure may be maintained and combat or balance the pressure imposed on the exterior of the mask 12. This may allow the mask 12 to sit more comfortably on the user's face. If equilibration of pressure is the only desired result, the injection of air into the mask 12 may be terminated 94 once a desired balance of pressures is obtained.

Alternatively, the injection of air may be continued until the pressure within the mask 12 is sufficient 92 to overcome the bias of the output valve 20. When the bias is overcome, gas or liquid must pass out of the mask 12 through the output valve 20. The gas or liquid expelled 96 or exhausted 96 through the output valve 20 largely depends on proximity thereto. If a liquid is pooled over the outlet valve 20 when the bias of the valve 20 is overcome, then the liquid will act as a seal to prevent any air within the mask 12 from escaping. In such an arrangement, the liquid, rather than the air, will first be pushed from the mask 12. Accordingly, a mask 12 may be purged of liquid water.

While relatively short, rapid injections of air into a mask 12 may be effective for balancing pressures and purging liquid, a slow bleed of air into a mask 12 may be more effective at removing vapor therefrom. In general, the processes that control the formation and destruction of vapor take more time than is required to purge a mask. For example, at the temperatures and pressures typically found inside a mask 12, evaporation 98 of any significant amount of water may take a significant amount of time. Thus, a significant amount of time may be required for condensate on the lens 14 of a mask 12 to evaporate 98. Moreover, since the lens 14 is at approximately ambient water temperature and the face of a user is at over ninety-eight degrees Fahrenheit, condensation will most certainly occur on the lens 14.

In a closed, stable system, rates of evaporation 98 and condensation 100 eventually reach an equilibrium where vapor is formed by evaporation 98 and removed by condensation 100 at the same rate. In such a system, the amount of condensate is constant. The cavity formed between the face of a user and a mask 12 is not a closed system. Generally, the amount of vapor forming within a mask 12 increases until the air contained therein becomes saturated. As may be expected, greater amounts of vapor result in greater amounts of condensate, which tend to fog and cloud the lens 14 of a mask 16 with tiny droplets.

By injecting a bleed of air into the cavity formed between the face of a user and a mask 12, the pressure may be increased until the bias of the output valve 20 is overcome. At that point, any additional air introduced will cause air, liquid, or some combination thereof to be expelled from the mask 12 out the output valve 20. Any air leaving the mask 12 will carry with it the vapor contained therein. Accordingly, condensate on the lens 14, as well as other liquids, with continue to evaporate 98. However, as the humid air 102 (i.e. air laden with vapor) is expelled, there is less vapor 104 to condense 100. Even droplets of liquid water inside the mask 12 but not on the lens 14 will tend to evaporate. As a result, within a selected period of time, the rate of condensation 100 with resulting fogging will decrease until the lens 14 is clear.

Figure 10:
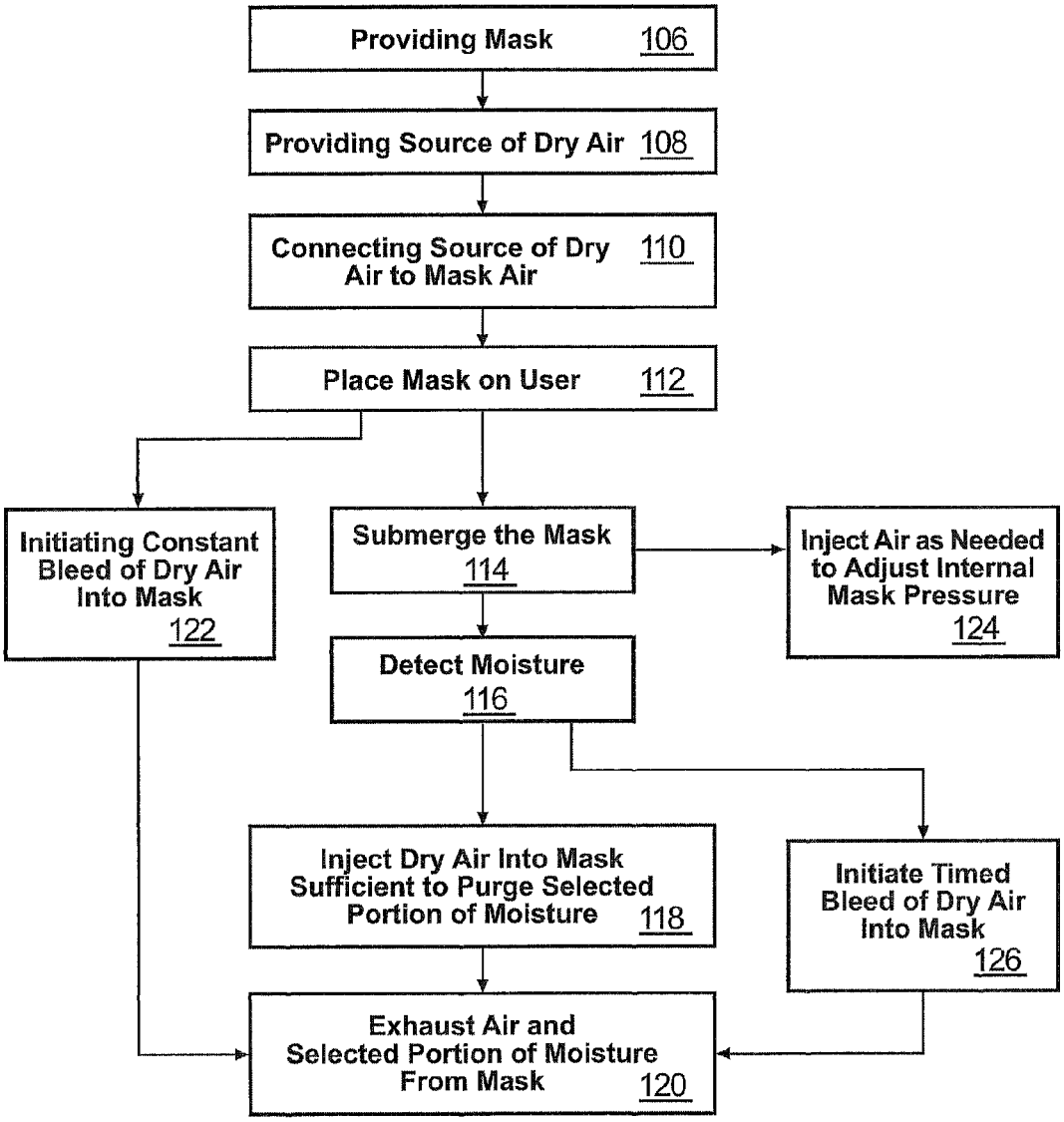
FIG. 10 is a block diagram illustrating the various methods in which an apparatus in accordance with the invention may be used.

Referring to FIG. 10, an apparatus in accordance with the present invention may be operated using a variety of methods. For example, in selected embodiments, a mask 12 may be provided 106. A source of dry air 86 (e.g. completely dry or comparatively dry) may also be provided 108. The source of dry air 86 may be connected 110 to the mask 12. The mask 12 may then be placed 112 on a user and immersed 114.

When a user detects 116 excessive moisture 88 in the within the mask 12 (i.e. the cavity formed between the face of a user and the mask 12), he or she may inject 118 (e.g. by pushing a button 66 on an inlet valve 18) dry air 86 into the mask 12. The amount of air 86 injected 118 may be selected to purge a selected portion of the moisture 88. An increase in pressure within the mask 12 may exhaust 120 moisture 88 in the form of liquid out an output valve 20. The flow of air caused by the increase in pressure may exhaust 102 humid air 102 and facilitate evaporation of condensate formed on the lens 14 of the mask 12.

An alternative solution is a substantially constant flow of dry air 86. In selected embodiments, after (or before, if desired) a mask 12 is placed 112 on a user, a constant bleed of dry air 86 into the mask 12 may be initiated 122. The bleed may be started before or after the user submerges with the mask 12 under the water. The amount of the bleed may be selected to maintain the lens 14 of the mask 12 substantially free of condensate. In such an arrangement, the pressure within the mask 12 may increase until moisture 88 in the form of liquid pooled near or over the output valve 20 is exhausted 120 therethrough. Alternatively, a user may initiate a periodic introduction of dry air 86 at intervals. A substantially constant flow, however, is contemplated to be easiest for a diver to use. For example, it may be started at the surface and never be considered again.

In certain embodiments, after a mask 12 is placed 112 on a user and the user immerses the mask 12 under the water, air 86 may be injected 124 into the mask 12, as needed, to adjust the internal mask pressure. An increase in the pressure within a mask 12 may balance an ever increasing external pressure on the mask 12 as the user descends to greater depths. This balancing of internal pressure with external pressure may allow the mask 12 to sit more comfortably on the user's face.

In an alternative embodiment, upon detecting 116 excessive moisture 88 in the within the mask 12, a user may initiate 126 a timed bleed of dry air 86 into the mask 12. The amount of air 86 injected 118 may be selected to purge a selected portion of the moisture 88. For example, in selected embodiments, a bleed of two minutes may be initiated if it is determined that such a bleed will effectively remove pooled liquids and vision-obscuring condensate in that time. Such an arrangement may provide more efficient use of generally limited supplies of dry air 86.

Figure 11:
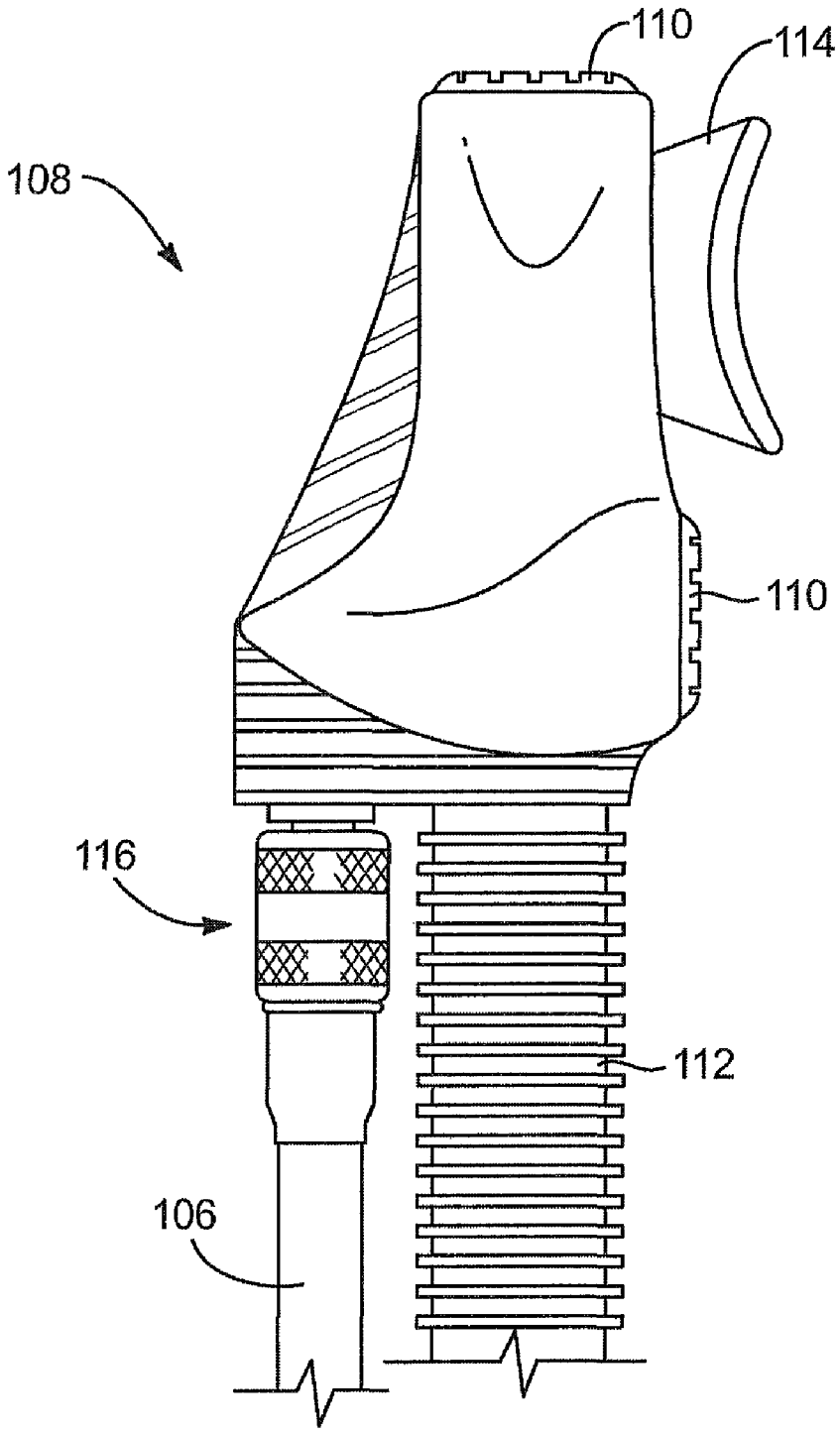
FIG. 11 is a side elevation view of an inflator and inflator hose.
Figure 12:
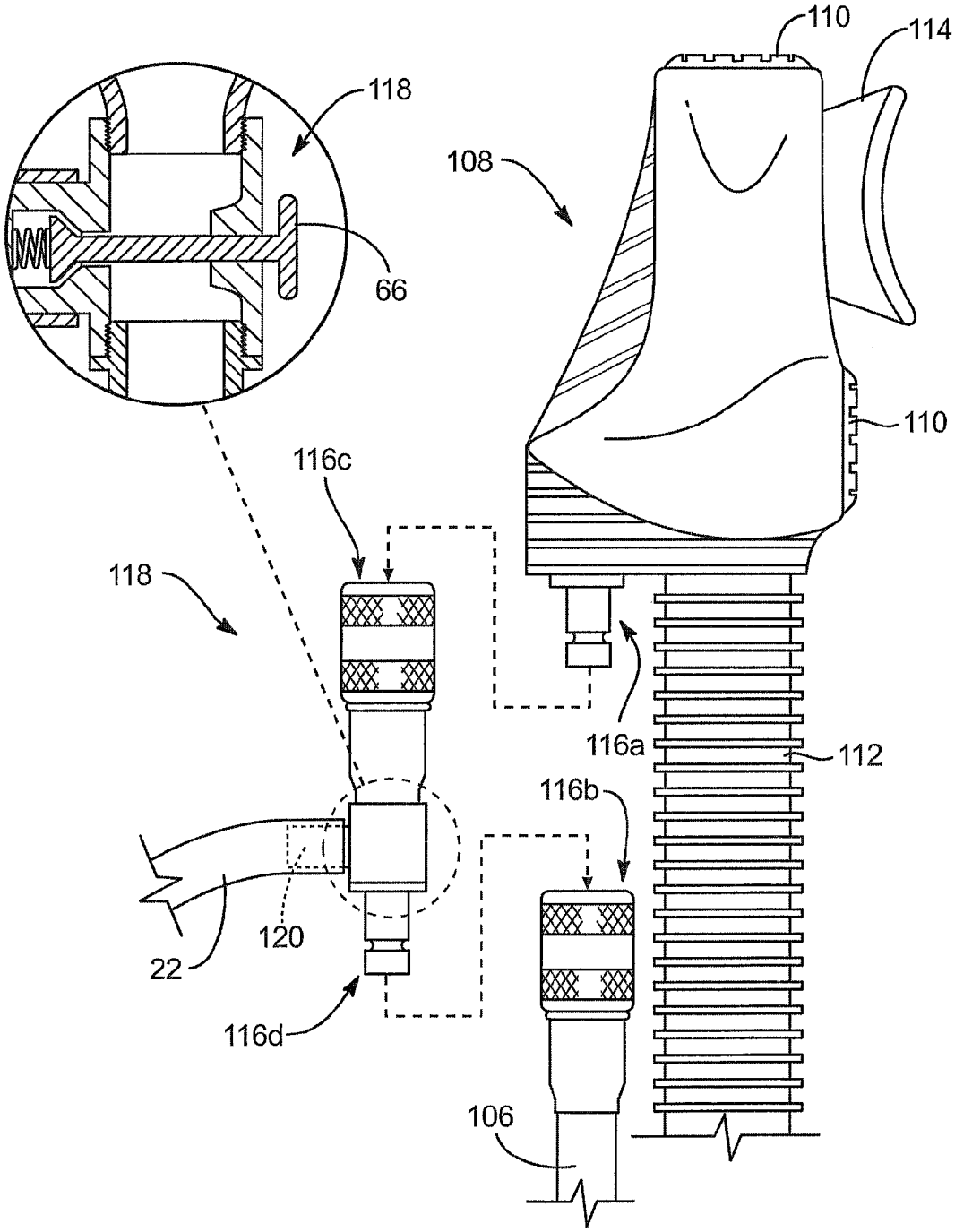
FIG. 12 is a side elevation view of an adapter securable between the inflator and inflator hose of FIG. 11 for providing air to a mask, in accordance with the present invention.

Referring to FIGS. 11 and 12, as presented hereinabove, air 86 may be extracted from any of numerous locations and communicated to a mask 12 in accordance with the present invention. While some locations may be more convenient than others, any method or structure for communicating air 86 to a mask 12 is included within the scope of the present invention.

One particularly convenient location to extract air 86 for a mask 12 is the junction between the inflator hose 106 and the inflator 108 for a buoyancy compensation device (BCD). In general, laws require the use of BCDs. Accordingly, all first stage regulators 32 are equipped to supply air 86 to an inflator hose 106 during underwater operation. For ease of use and quick access, inflators 108 for BCDs are generally located near the hip of a user. As a result, inflator hoses 106 typically extend from the first stage regulator 32, over the shoulder or under the arm of a user, and down the torso to engage the inflator 108.

Inflators 108 for BCDs typically include two buttons 110. One button 110 may control the passage of air 86 from the inflator hose 106 into the BCD. The other button 110 may control the passage of air 86 out of the BCD. Inflators 108 may secure directly to the BCD or include a hose 112 providing fluid communication between the inflator 108 and the BCD. Inflators 108 may also include a crude mouthpiece 114 allowing a user to breathe the air stored in the BCD during an extreme emergency.

In most cases, the connection between the inflator hose 106 and the inflator 108 is made using a quick disconnect 116. A quick disconnect 116 typically involves a male piece **116*a* and a female piece 116*b*. Using a quick disconnect 116, an inflator hose 106 may quickly and easily be connected to, and disconnected from, the inflator 108**.

In selected embodiments in accordance with the present invention, an adapter 118 may be inserted between the inflator 108 and the inflator hose 106. For example, an adapter 118 may include a female piece **116*c* to engage a male piece 116*a* extending from the inflator 108. Similarly, the adapter 118 may include a male piece 116*d* to engage a female piece 116*b* secured to the end of the inflator hose 106. Accordingly, in a matter of seconds, an adapter 118** in accordance with the present invention may be applied (retrofitted) to standard equipment already owned by most scuba divers with no modification required.

An adapter 118 may include an extension 120 or nipple 120 to which a supply tube 22 may secure. In such an arrangement, the supply tube 22 may extend from the adapter 118 up though the restraints (e.g. ties) that generally secure the inflator hose 106 to the BCD.

The tube 22 may then transition over to the mask 12 at a location that would not interfere with a user's range of motion or vision.

In selected embodiments, an adapter 118 may provide a substantially constant bleed of air 86 to the supply tube 22. Alternatively, an adapter 118 may include an inlet valve 18 incorporated therewithin. Users are accustomed to reaching for a inflator 108 to adjust buoyancy. It may be a small adjustment in routine for a user to learn to reach for the inflator 108 and press a button 66 to purge a mask 12.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed and desired to be secured by United States Letters Patent is:

1. A system for purging of an underwater mask, the system comprising:

an underwater mask comprising a lens, skirt, and inlet;

an adapter configured to interface between and connect an inflator hose and a buoyancy compensation device; and an auxiliary hose, comprising an auxiliary line providing an independent and direct path of air from the adapter to the inlet of the underwater mask.

2. The system of claim 1, wherein the adapter comprises a female quick-disconnect coupler, a male quick-disconnect coupler, a conduit placing the female quick-disconnect coupler in fluid communication with the male quick-disconnect coupler, and a port placing the hose in fluid communication with the conduit.

3. The system of claim 2, wherein the inlet extends through at least one of the lens and skirt.

4. The system of claim 3, further comprising a valve controlling flow within the hose.

5. The system of claim 4, wherein the valve is positioned proximate the underwater mask.

6. The system of claims 4, wherein the valve is positioned proximate the adapter.

7. A system for purging of an underwater mask, the system comprising:

an underwater mask comprising a lens, skirt, and inlet;

an auxiliary hose, comprising an auxiliary line having a first end and a second end opposite the first end, the first end engaging the inlet and the auxiliary line providing an independent and direct path of air from an adapter to the inlet of the underwater mask; and the adapter comprising a female quick-disconnect coupler, a male quick-disconnect coupler, a conduit placing the female quick-disconnect coupler in fluid communication with the male quick-disconnect coupler, and a port engaging the second end of the hose and placing the hose in fluid communication with the conduit.

8. The system of claim 7, wherein the inlet extends through at least one of the lens and skirt.

9. The system of claim 8, further comprising a valve controlling flow within the hose.

10. The system of claim 9, wherein the valve is positioned proximate the underwater mask.

11. The system of claims 9, wherein the valve is positioned proximate the adapter.

12. A SCUBA system comprising:

a regulator;

a buoyancy compensation device;

an inflator hose having a first end and a second end opposite the first end, the first end engaging the regulator;

an adapter interfacing between and connecting the second end of the inflator hose and the buoyancy compensation device; an underwater mask comprising a lens for viewing through, a skirt extending from the lens, an inlet, and an outlet; and an auxiliary hose extending from the adapter and comprising an auxiliary line providing an independent and direct path of air from the adapter to the inlet of the underwater mask.

13. The system of claim 12, wherein:

the auxiliary hose comprises a first end and a second end opposite the first end;

the first end of the auxiliary hose engages the adapter; and the second end of the auxiliary hose engages the inlet.

14. The system of claim 13, further comprising a tank containing a fluid.

15. The system of claim 14, wherein the regulator is connected to the tank and regulates the pressure of the fluid as it leaves the tank and enters the inflator hose.

16. The system of claim 15, wherein the inflator hose conduits the fluid toward the buoyancy compensation device.

17. The system of claim 16, wherein the adapter passes a first portion of the fluid into the buoyancy compensation device and a second portion of the fluid into the auxiliary hose.

18. The system of claim 17, wherein the auxiliary hose conduits the second portion of the fluid to the inlet.

19. The system of claim 18, further comprising a valve controlling the flow of the second portion of the fluid within the auxiliary hose.

20. The system of claim 19, wherein the valve is positioned proximate one of the underwater mask and the adapter.

* * * * *